US006221572B1

(12) United States Patent
Hagemann et al.

(10) Patent No.: US 6,221,572 B1
(45) Date of Patent: Apr. 24, 2001

(54) COLOR PHOTOGRAPHIC MATERIAL

(75) Inventors: Jörg Hagemann, Köln; Günter Helling, Odenthal; Heinrich Odenwälder, Leverkusen, all of (DE)

(73) Assignee: Afga-Gevaert Naamloze Vennootschap (BE)

( * ) Notice: Subject to any disclaimer, the term of this patent is extended or adjusted under 35 U.S.C. 154(b) by 0 days.

(21) Appl. No.: 09/078,418

(22) Filed: May 14, 1998

(30) Foreign Application Priority Data

May 26, 1997 (DE) ..... 197 21 905
Dec. 13, 1997 (DE) ..... 197 55 546

(51) Int. Cl.[7] ..... G03C 7/30
(52) U.S. Cl. ..... 430/551; 430/558
(58) Field of Search ..... 430/551, 558

(56) References Cited

FOREIGN PATENT DOCUMENTS

| | | | |
|---|---|---|---|
| 273 412 | | 12/1987 | (EP) . |
| 273 712 | | 12/1987 | (EP) . |
| 457 543 | | 5/1991 | (EP) . |
| 656561 | * | 7/1995 | (EP) . |
| 4-19652 | * | 1/1992 | (JP) . |
| 4-19653 | * | 1/1992 | (JP) . |
| 9-281673 | * | 10/1997 | (JP) . |
| 9-325459 | * | 12/1997 | (JP) . |

* cited by examiner

*Primary Examiner*—Janet Baxter
*Assistant Examiner*—Amanda C. Walke

(74) *Attorney, Agent, or Firm*—Connolly Bove Lodge & Hutz LLP

(57) ABSTRACT

A color photographic material having a support and at least one light-sensitive silver halide emulsion layer and at least one color coupler associated with the latter, wherein the silver halide emulsion layer contains at least one compound of formula (I)

(I)

wherein m denotes 0, 1, 2, 3 or 4, n denotes 2, 3, 4, 5 or 6, $R_1$ denotes a di- to hexavalent group, $R_2$ denotes alkyl, alkenyl, cycloalkyl, aryl, alkoxy, aryloxy, alkylthio, arylthio, acyl, alkoxycarbonyl, aryloxycarbonyl, hydroxy, halogen, cyano, —$SO_2R_5$, —$SOR_5$, —$CON(R_5)R_6$ or —$SO_2N(R_5)R_6$, $L_1$ denotes alkylene, arylene, aralkylene or alkylidene, $L_2$ denotes $L_3$, $L_4$ denote a $C_1$–$C_3$ alkylene which is optionally substituted, $R_5$ denotes alkyl or aryl, and $R_6$ denotes H or $R_5$, wherein $L_2$ and X are as defined in the specification, is distinguished b improved stability to light.

14 Claims, No Drawings

COLOR PHOTOGRAPHIC MATERIAL

This invention relates to a colour photographic material having a support and at least one light-sensitive silver halide emulsion layer and at least one colour coupler associated with this layer, which on development with a colour developer forms a dye which is distinguished by improved stability to light due to a new type of dye stabiliser which is added to the layer.

It is known that dyes which are formed on the development of a colour photographic material, particularly magenta dyes, and quite particularly those which are based on pyrazolotriazole magenta couplers, have to be stabilised against their destruction by light. Thus, for example, EP 273 412 and EP 273 712 describe aminophenol ethers with cyclic amine substituents, and EP 457 543 describes the same compounds in combination with bisphenols as stabilisers for an azomethine dye formed from pyrazolotriazole magenta couplers. The effect of these materials, even in combination with other stabilisers, is still not satisfactory.

Compounds have now been found which impart a higher stability to dyes such as these, particularly in relation to light.

The present invention therefore relates to the material cited at the outset, characterised in that in the light-sensitive layers it contains at least one compound of formula (I)

(I)

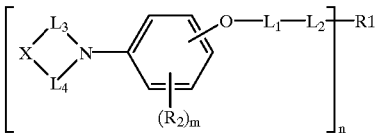

wherein m denotes 0, 1, 2, 3 or 4, n denotes 2, 3, 4, 5 or 6, $R_1$ denotes a di- to hexavalent group, $R_2$ denotes alkyl, alkenyl, cycloalkyl, aryl alkoxy, aryloxy, alkylthio, arylthio, acyl, alkoxycarbonyl, aryloxycarbonyl, hydroxy, halogen, cyano, $—SO_2R_5$, $—SOR_5$, $—CON(R_5)R_6$ or $—SO_2N(R_5)R_6$, $L_1$ denotes alkylene, arylene, aralkylene or alkylidene, $L_2$ denotes

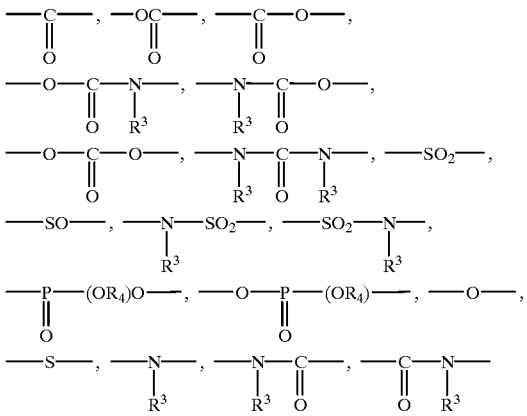

$L_3$, $L_4$ denote a $C_1$–$C_3$ alkylene which is optionally substituted,

X denotes

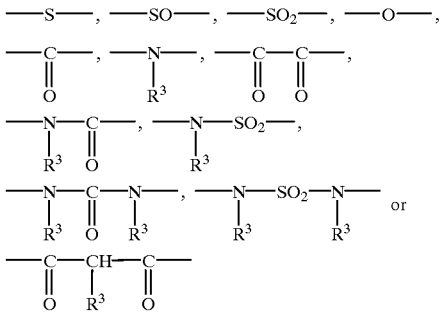

or $R_3$ denotes H, acyl, $—SO_2R_5$, alkoxycarbonyl aryloxycarbonyl alkyl aryl, alkenyl or the radical of a heterocycle, $R_4$ denotes H, alkyl, aryl or the radical of a heterocycle, $R_5$ denotes alkyl or aryl, and $R_6$ denotes H or $R_5$, wherein 2 $R_3$ and $R_4$ radicals may be the same or different.

Preferably, $R_1$ denotes a di- to hexavalent aliphatic or aromatic group, $R_2$ denotes alkyl, alkoxy, acyl, alkoxycarbonyl or hydroxy, $R_3$ denotes H or alkyl, $L_1$ denotes alkylene, arylene or aralkylene, $L_2$

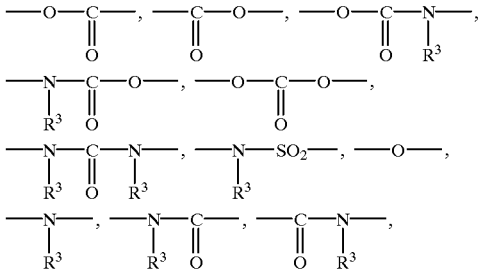

X denotes —SO—, $—SO_2—$, —CO— or —O—, and m denotes 0, 1 or 2, wherein $L_3$ and $L_4$ together contain 3 to 5 C atoms.

The compounds of formula I preferably have a molecular weight of at least 650. They are used in particular in an amount of 5 to 1500 mg/$m^2$, preferably 10 to 500 mg/$m^2$ of colour photographic material.

Examples of compounds according to the invention are:

a) $L_3$=$L_4$=$—CH_2—CH_2—$; linkage of the $—O—L_1—L_2—R_1$ group para to the nitrogen; position of $R_2$ given with respect to O.

I-1

X = O; m = 0;

$L_1$–$L_2$ = —$(CH_2)_4$—NHCO—, n = 2

$R_1$ = 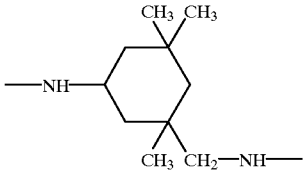

I-2

X = $SO_2$; m = 0;

$L_1$–$L_2$ = —$CH_2$—CH($C_{10}H_{21}$)—O—C(=O)—; n = 2

$R_1$ = 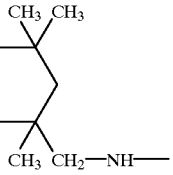

I-3

X = $SO_2$; m = 1; $R_2$ = -o-$CH_3$;

$L_1$–$L_2$ = —CH($C_{12}H_{25}$)—C(=O)—; n = 2

$R_1$ = 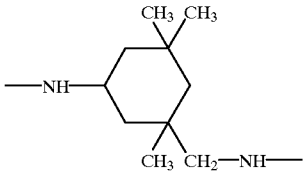

I-4

X = $SO_2$; m = 0;

$L_1$–$L_2$ = —$CH_2$—CH($C_{10}H_{21}$)—O—C(=O)—; n = 2

$R_1$ = —NH—$(CH_2)_2$—$C(CH_3)_2CH_2$—$CH(CH_3)$—$CH_2$—NH—

I-5

X = CO; m = 0;

$L_1$–$L_2$ = —$CH_2$—CH(O—C(=O)—$C_5H_{11}$)—$CH_2$—; n = 2

$R_1$ = —NH—$(CH_2)_2$—$C(CH_3)_2CH_2$—$CH(CH_3)$—$CH_2$—NH—

I-6

X = O; m = 0;

$L_1$–$L_2$ = —$(CH_2)_4SO_2$—; n = 2

$R_1$ = —NH—$(CH_2)_2$—$C(CH_3)_2$—$CH_2CH(CH_3)$—$CH_2$—NH—

I-7

X = $SO_2$; m = 0;

$L_1$–$L_2$ = —$CH_2$—CH($C_{10}H_{21}$)—OC(=O)—; n = 2

$R_1$ = —NH—$(CH_2)_3O$—$(CH_2)_2O$—$(CH_2)_3$—NH—

I-8

X = SO; m = 0;

$L_1$–$L_2$ = —CH($C_{16}H_{33}$)—C(=O)—O—; n = 2

$R_1$ = —$CH_2$—$CH_2$—

I-9

X = $SO_2$; m = 0;

$L_1$–$L_2$ = —$(CH_2)_4$—NH—; n = 2

$R_1$ = 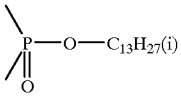

(mixture of isomers)

I-10

X = O; m = 0;

$L_1$–$L_2$ = —CH($C_4H_9$)—$CH_2$—O—; n = 2

$R_1$ = 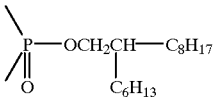

I-11

X = $SO_2$; m = 0;

$L_1$–$L_2$ = —CH($C_2H_5$)—C(=O)—O—$CH_2$—; n = 2

$R_1$ = —$C(CH_3)_2$—

I-12

X = CO; m = 0;

$L_1$–$L_2$ = —CH($C_6H_{13}$)—C(=O)—O—$CH_2$—; n = 3

$R_1$ = 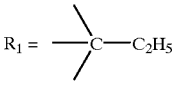

I-13

X = $SO_2$; m = 1; $R_2$ = m-O—$C_3H_7$(i);

$L_1$–$L_2$ = —$(CH_2)_3$—O—; n = 3;

$R_1$ = 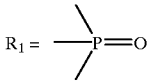

-continued

I-14

X = $SO_2$; m = 0;

$L_1$–$L_2$ = —$CH_2$—CH(—$C_{10}H_{21}$)—O—CONH— (ring: $H_3C$, —$NHCOOCH_2$—) ; n = 3

$R_1$ = —C(—)(—)—$C_2H_5$

I-15

X = $SO_2$; m = 1; $R_2$ = o-Cl;

$L_1$–$L_2$ = —$(CH_2)_4$N(—$(CH_2)_2COOCH_3$)—CONH— (ring: $H_3C$, —$NHCOOCH_2$—) ; n = 3

$R_1$ = —C(—)(—)—$C_2H_5$

I-16

X = $SO_2$; m = 0;

$L_1$–$L_2$ = —$CH_2$—CH(—$C_{10}H_{21}$)—OCONH—$(CH_2)_6$— ; n = 3

$R_1$ = —NHCO—N(—)—CONH—

I-17

X = O; m = 1; $R_2$ = o-$OCH_3$;

$L_1$–$L_2$ = —$(CH_2)_3$—OCONH—$(CH_2)_6$— ; n = 3;

$R_1$ = —NHCO—N(—)—CONH—

I-18

X = $SO_2$; m = 1; $R_2$ = o-$CH_3$;

$L_1$–$L_2$ = —$(CH_2)_3COOCH_2$; n = 4;

$R_1$ = —C(—)(—)—

I-19 a 1:1-mixture of a)

X = $SO_2$; m = 0;

$L_1$–$L_2$ = —$CH_2$—CH(—$C_4H_9$)—OCO— ; n = 4, $R_1$ = —$OCH_2$—(CH)(—O—)—$CH_2$—O— and b)

X = $SO_2$; m = 0;

$L_1$–$L_2$ = —$CH_2$—CH(—$C_{12}H_{25}$)—OCO— ; n = 4, $R_1$ = —$OCH_2$—(CH(—O—))—$CH_2$—O—

I-20

X = $SO_2$; m = 0;

$L_1$–$L_2$ = —CH(—$C_8H_{17}$)—$(CH_2)_8$—C(=O)— ; n = 5, $R_1$ = —$OCH_2$—(CH(—O—))$_3$—$CH_2$—O—

-continued

I-21

X = $SO_2$; m = 0;

$L_1$–$L_2$ = —CH(C$_4$H$_9$)—C(=O)— ; n = 6

$R_1$ = —$OCH_2$—(CH)$_4$(O—)—$CH_2$—O—

I-22

X = SO; m = 0;

$L_1$–$L_2$ = —$(CH_2)_2$—C(=O)—$(CH_2)_{10}$NHCO ; n = 2

$R_1$ =

I-23

X = SO; m = 0;

$L_1$–$L_2$ = —$(CH_2)_4$NHCO— ; n = 2

$R_1$ = $C_4H_9$—CH($C_2H_9$)$CH_2$OCO— (1,4-phenylene) —COO$CH_2$—CH($C_2H_9$)$C_4H_9$

I-24

X = $NSO_2$— (1,4-phenylene) —$CH_3$ ; m = 1; $R_2$ = o-$CH_3$;

$L_1$–$L_2$ = —$(CH_2)_2$—O ; n = 3;

$R_1$ = —B(—)—

I-25

X = $SO_2$; m = 1; $R_2$ = o-$OC_3H_7$(i);

$L_1$–$L_2$ = —$(CH_2)_4$NHCO— ; n = 2;

$R_1$ = —$(CH_2)_4$—

I-26

X = $SO_2$; m = 0;

$L_1$–$L_2$ = —$(CH_2)_3$—OCO— ; n = 3;

$R_1$ = $C_{10}H_{21}$CH($C_8H_{17}$)—COOC($CH_2$—)($CH_2$—)—

I-27

X = O; m = 0;

$L_1$–$L_2$ = —$(CH_2)_4$—NHCO— ; n = 3;

$R_1$ = $C_{13}H_{27}$(i)—COOC($CH_2$—)($CH_2$—)—

I-28

X = $SO_2$; m = 0;

$L_1$–$L_2$ = —$(CH_2)_4$—O— ; n = 2;

$R_1$ = —[$(CH_2)_4$—O]$_7$—$(CH_2)_4$—

I-29

[$O_2S$—N (1,4-phenylene) —O—$(CH_2)_4$—NH—P(=O)]$_3$

I-30

[$O_2S$—N (1,4-phenylene) —O$(CH_2)_2$—OC(=O)NH— (2-methyl-1,4-phenylene) —$NHCOOCH_2$]$_3$—C—$C_2H_5$ ($C_{15}H_{31}$ on the sulfonamide ring)

I-31

[$O_2S$—N (1,4-phenylene) —$OCH_2$—CH($C_{12}H_{25}$)—O—$Si(CH_3)_2$]$_2$

I-32

[(2,6-piperidinedione)—N (1,4-phenylene) —$OCH_2$—CH($CH_2OCH_3$)—OCO—$(CH_2)_4$]$_2$

I-28

X = $SO_2$; m = 0;

$L_1$–$L_2$ = —$(CH_2)_4$—O— ; n = 2

$R_1$ = —[$(CH_2)_4$—O]$_7$—$(CH_2)_4$—

I-29

[$O_2S$—N (1,4-phenylene) —O—$(CH_2)_4$—NH—P(=O)]$_3$

-continued

I-30

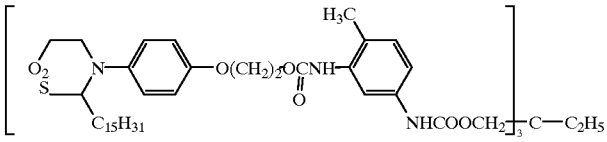

I-31

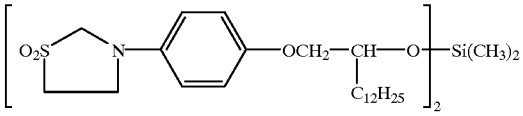

I-32

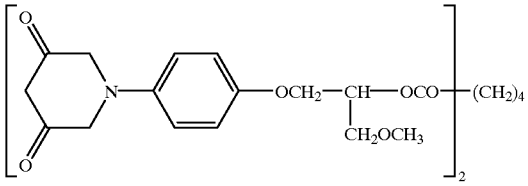

In one preferred embodiment, the layer containing the magenta coupler also contains at least one compound of formula II or III in addition:

(II)

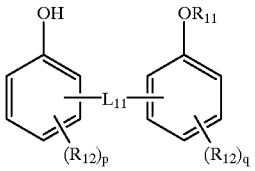

wherein $R_{11}$ denotes H, acyl, alkoxycarbonyl, —CON($R_5$)$R_6$, —$SO_2R_5$, —$SO_2N(R_5)R_6$, aryloxy-carbonyl, alkyl or alkenyl, $R_{12}$ denotes alkyl, aryl, aralkyl, alkenyl, halogen, alkoxy, acyloxy, aryloxy, acyl, acyl-amino, —CON($R_5$)$R_6$, alkoxycarbonylamino, —N($R_6$)CON($R_5$)$R_6$, alkoxy-carbonyl or aryloxycarbonyl, p, q denote 0 or a number from 1 to 4, $L_{11}$ denotes

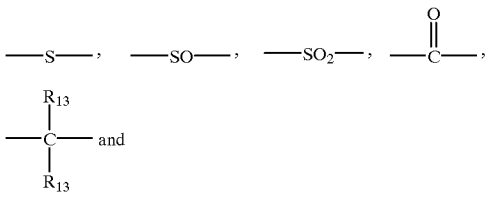

$R_{13}$ denotes H, alkyl, aryl, acyl, alkoxycarbonyl, —CON ($R_5$)$R_6$ or aryloxycarbonuyl, wherein a plurality of radicals $R_{12}$, $R_{13}$ may be the same or different, and one substituent is situated para to the OH or $OR_{11}$ in each case, (III)

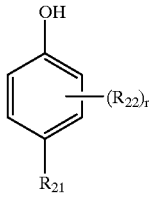

wherein $R_{21}$ denotes alkyl, aryl, alkoxy, aryloxy, hydroxy, acyl, alkoxycarbonyl, aryloxycarbonyl, carbamoyl, —CON ($R_5$)$R_6$, —$SO_2R_5$, —$SO_2N(R_5)R_6$, alkoxycarbonylamino, —N($R_6$)CON($R_5$)$R_6$ or acyloxy, $R_{22}$ denotes $R_{21}$ or halogen, and r denotes 0 or an integer from 1 to 4, wherein a plurality of radicals $R_{22}$ may be the same or different.

The compounds of formulae (II and (III) are used in a total amount of 5 to 1500 mg/$m^2$ in each case, preferably 10 to 750 mg/$m^2$.

Examples of compounds of formulae II and III are:

II-1

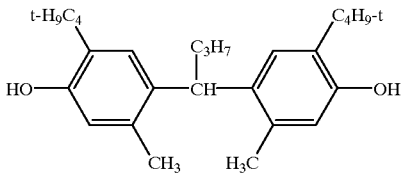

II-2

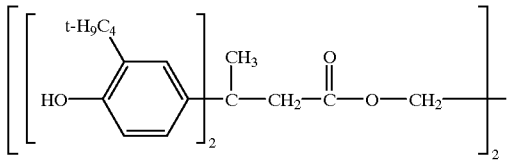

-continued

II-3

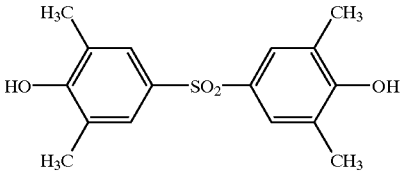

II-4

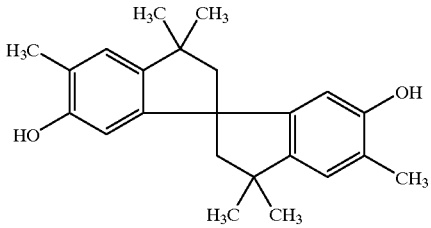

II-5

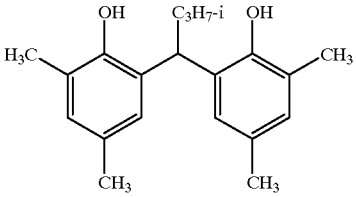

II-6

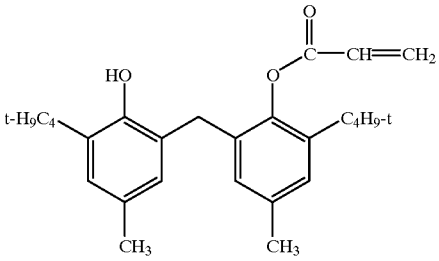

II-7

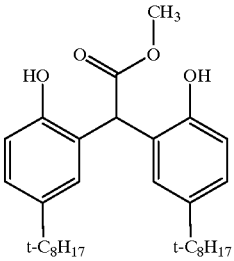

III-1

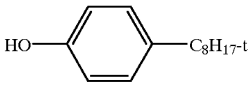

III-2

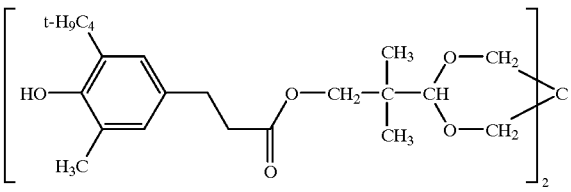

-continued

III-3

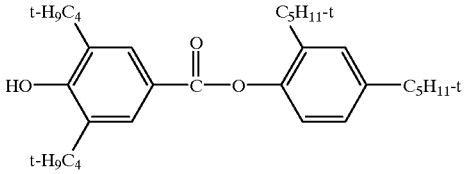

III-4

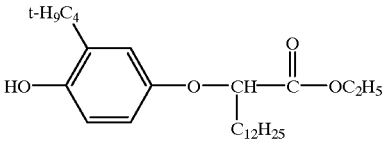

III-5

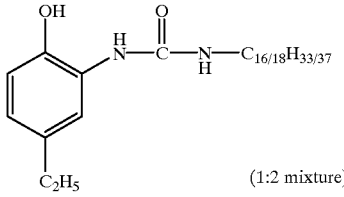

(1:2 mixture)

III-6

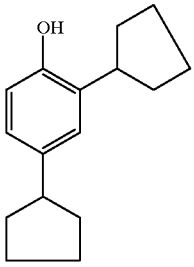

III-7

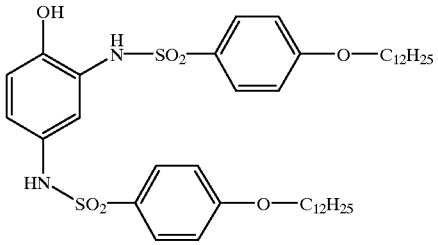

Examples of colour photographic materials include colour negative films, colour reversal films, colour positive films, colour photographic paper, colour reversal photographic paper, and colour-sensitive materials for the colour diffusion transfer process or the silver halide bleaching process.

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf Rec Mats., 1994, Vol. 22, pages 183–193, and in Research Disclosure 38957, Part Xl (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are the binder, the silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part XC (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 mm diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (995), page 84, and in Research Disclosure 38957, Part XD (1996), page 621.

The photographic material may additionally contain compounds which absorb UV light, brighteners, spacers, filter dyes, formalin scavengers, light stabilisers, anti-oxidants, $D_{Min}$ dyes, additives fr improving the dye-, coupler- and white stability and to reduce colour fogging, plasticisers (latices), biocides and other substances.

Suitable compounds are given in Research Disclosure 37254, Part 8 (1995), page 292, in Research Disclosure 37038, Parts IV, V, Vl, VII, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part IIB (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), together with examples of materials.

The magenta couplers are preferably those which have pyrazolotriazole structures of formulae (IV) or (V):

(IV)

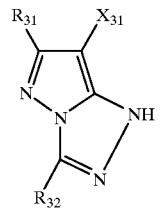

-continued
(V)
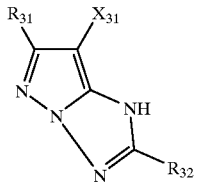
wherein
$X_{31}$ denotes H or a group which is split off under the conditions of chromogenic development,
$R_{31}$ denotes an alkyl, which is optionally substituted, and
$R_{32}$ denotes $R_{31}$ or aryl,
wherein the sum of all the C atoms of radicals $R_{31}$ and $R_{32}$ in a coupler molecule is at least 12.
Examples of suitable couplers include:
M-1
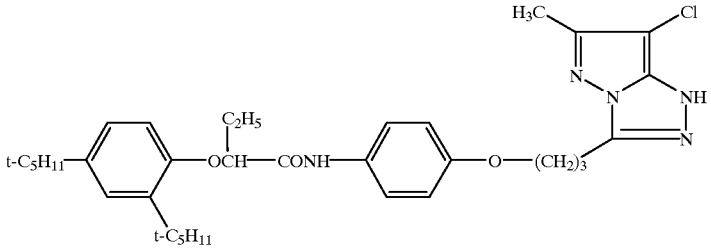
M-2
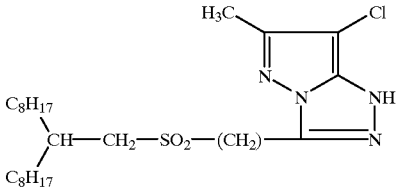
M-3
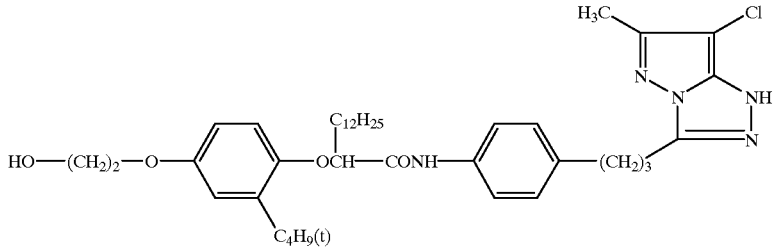
M-4
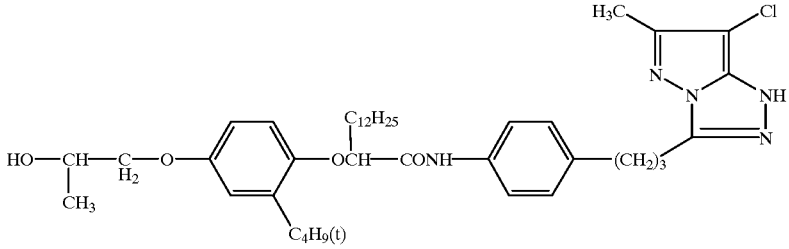
M-5
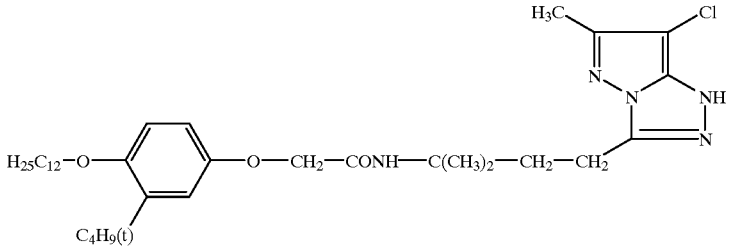

-continued
M-6
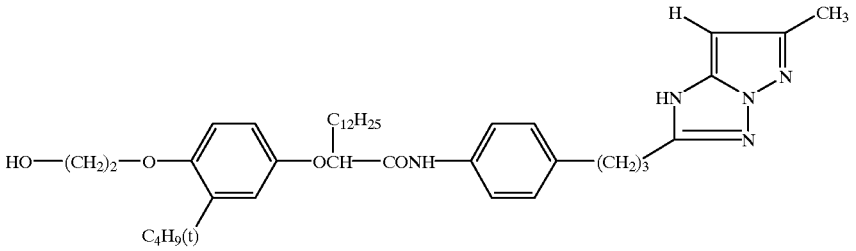
M-7
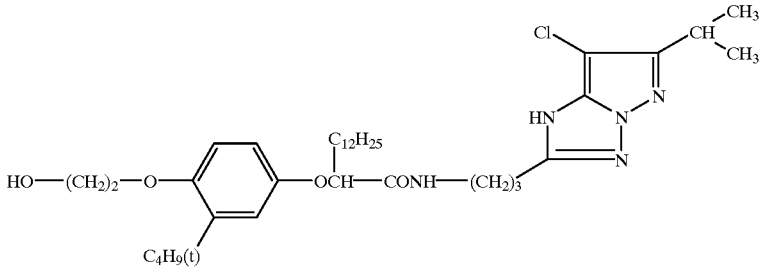
M-8
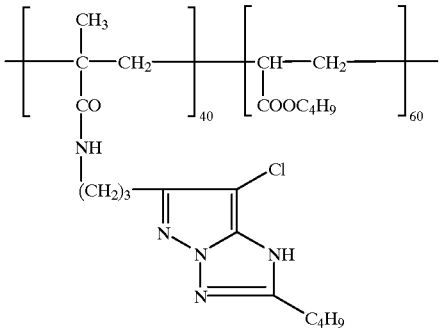
M-9
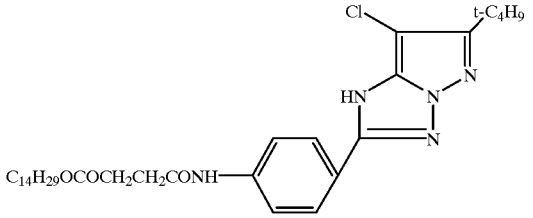
M-10
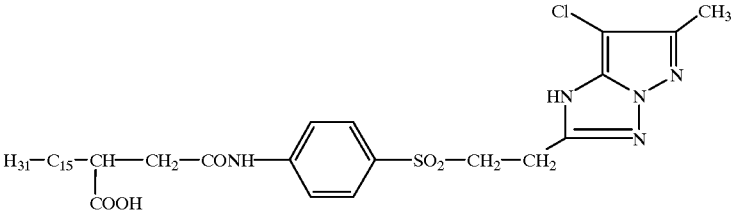
M-11
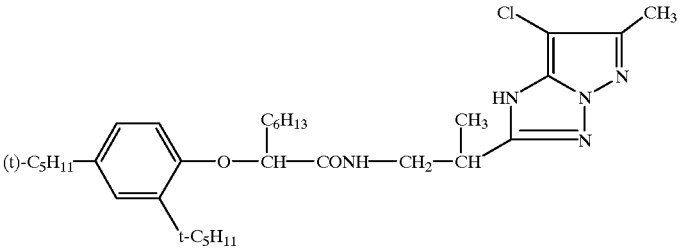

-continued
M-12
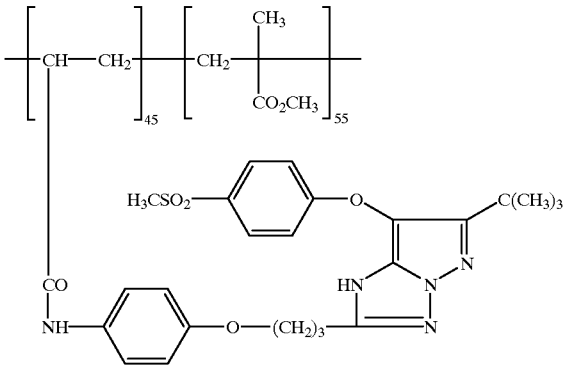
M-13
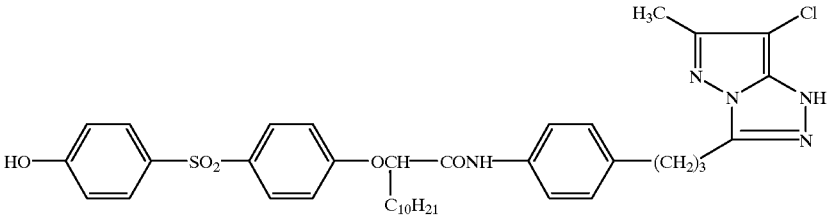
M-14
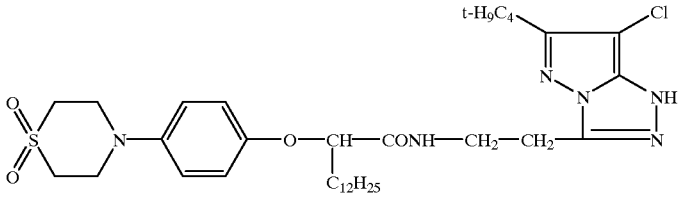
M-15
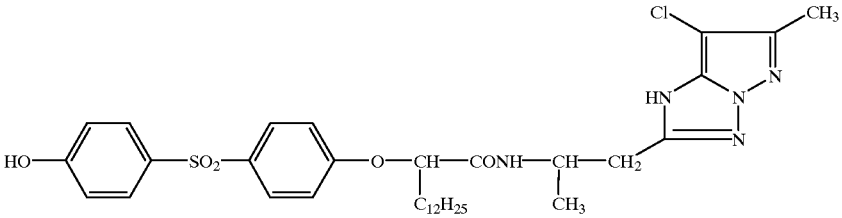
M-16
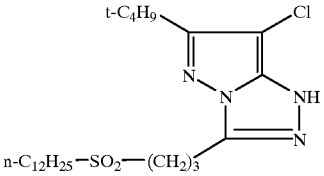
M-17
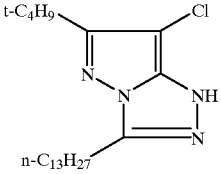

In one particularly preferred embodiment, at least one light-insensitive layer contains a compound of formula VI or VII (VI)

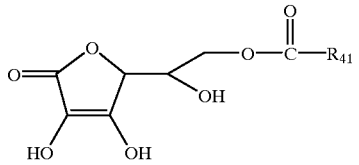

wherein $R_{41}$ denotes alkyl, alkoxy, alkylamino, aryl, aryloxy or arylamino, and $R_{41}$ contains at least 12 C atoms.

(VII)

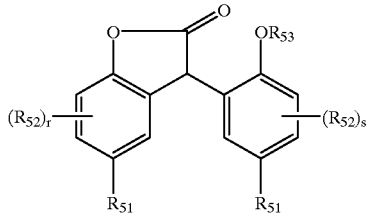

wherein $R_{51}$, $R_{52}$ denote alkyl, alkoxy, acylamino, acyloxy, alkoxycarbonylamino, N¢-alkylureido, N¢-arylureido or sulphonylamino, and $R_{53}$ denotes H, alkyl, acyl, alkyl carbamoyl, alkoxy carbamoyl, alkyl sulfonyl, r, s denote 0, 1 or 2, and wherein a plurality of radicals $R_{51}$, $R_{52}$ may be the same or different and adjacent radicals $R_{51}$ and $R_{52}$ can form a 5- to 6-membered ring.

$R_{41}$ is preferably alkyl, $R_{51}$ is preferably alkyl or alkoxy, $R_{52}$ is preferably alkyl, and r, s are preferably 0 or 1.

The compounds of formulae (VI) and (VII) are used in a total amount of 5 to 1000 mg/r$^2$ in each case, preferably 10 to 500 mg/m$^2$.

Examples of compounds of formulae (VI) and (VI are:

VI-1 $R_{41}=C_{11}H_{23}$

VI-2 $R_{41}=C_{15}H_{31}$

VI-3 $R_{41}=C_6H_{13/—CH—C8}H_{17}$

VI-4 $R_{41}=C_{17}H_{35}$

VII-1 $R_{51}=C_8H_{17-t}$, $R_{52}$=H, $R_{53}$=H

VII-2 $R_{51}=CH_3$, $R_{52}=C_4H_{9-t}$, $R_{53}$=H

VII-3 $R_{51}=C_8H_{17-t}$, $R_{52}=CH_3$,$R_{53}$=H

VII-4 $R_{51}=R_{52}=C_4H_{9-t}$, $R_{53}$=H

VII-5 $R_{51}=R_{52}=C_5H_{11}$-t, $R_{53}$=H

VII-6 $R_{51}$ $C_4H_{9-t}$, $R_{52}=OCH_3$, $R_{53}$=H

VII-7 $R_{51}$=t-$C_8C_{17}$, $R_{52}$=H, $R_{53}=COCH_3$

VII-8 $R_{51}=CH_3$, $R_{52}$=t-$C_4H_9$,$R_{53}$=COCH═$CH_2$

VII-9 $R_{51}=R_{52}$=t-$C_5H_{11}$, $R_{53}=COOC_2H_5$

VII-10 $R_{51}=R_{52}$=t-$C_4H_9$, $R_{53}=CONHC_4H_9$

The radicals 52 are situated in the ortho position in relation to oxygen.

VII-11

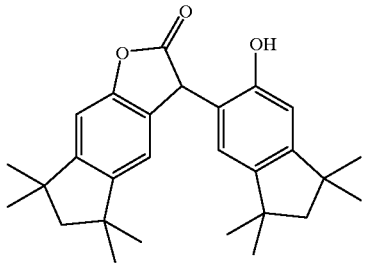

VII-12

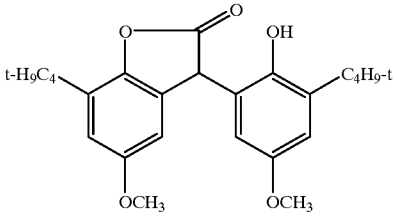

Emulsions containing more than 80 mole % AgCl, particularly more than 95 mole % AgCl, are preferably used as the light-sensitive silver halide emulsion; AgBrCl emulsions containing 95 to 99.5 mole % AgCl are most preferably used.

Synthesis of I-2

A mixure of 41.2 g S,S-dioxo-N-(4-(2-hydroxydodecyloxy)-phenyl)-thiazane, 9.9 g isophorone diisocyanate and 250 ml xylene was heated at 120° C. for 30 hours. Thereafter, the xylene was completely removed by distillation under vacuum. 50.5 g I-2 were obtained as a brownish yellow resin.

Synthesis of I-8

A solution of 16 g phosphoric acid isotridecyl ester dichloride in 50 ml $CH_2Cl_2$ was added drop-wise at 0° C. to a solution of 29.8 g N-(4-(4-amninobutoxy)phenyl)-S,S-dioxothiazane in 100 ml $CH_2Cl_2$ and 50 ml pyridine, and the batch was allowed to warm up to 20° C. It was stirred for 6 hours, and the organic phase was washed with water, 10 % by weight hydrochloric acid and half-saturated common salt solution. After the complete removal of the solvent, 33 g I-8 were obtained as a slightly yellow solid which had solidified in a glassy form.

Synthesis of I-31

12.6 g methanesulphonic acid chloride were added drop-wise at 0° C. to a solution of 33.3 g polytetrahydrofuran (M=660) and 11.2 g triethylamine in 500 ml $CH_2Cl_2$ and the batch was allowed to warm up to 20° C. with stirring. After 2 hours, the precipitate was filtered of and the organic phase was washed with water. 5 % by weight hydrochloric acid, 5% by weight aqueous sodium hydroxide solution and saturated common salt solution. The solvent was removed completely. The viscous oil was dissolved in 250 ml DMF, 24.6 g S,S-dioxo-N-(4-hydroxyphenyl)-thiazane and 15 g $K_2CO_3$ were added thereto and the batch was heated to 95° C. for 48 hours. The reaction mixture was added to 750 ml water and was extracted three times with 200 ml ethyl acetate each time. The organic phase was washed with half-saturated common salt solution, 10% by weight aqueous sodium hydroxide solution and water. After complete concentration by evaporation, 52.6 g I-31 were obtained as a dark yellow, viscous oil.

EXAMPLES

Example 1

A colour photographic recording material was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

Layer structure 1

Layer 1 (substrate layer)

0.10 g gelatine

Layer 2 (blue-sensitive layer)

blue-sensitive silver halide emulsion (99.5 mole % chloride, 0.5 mole % bromide, average grain diameter 0.9 mm), comprising 0.50 g $A2NI_3$, with
- 1.25 g gelatine
- 0.42 g yellow coupler Y-1
- 0.18 g yellow coupler Y-2
- 0.50 g oil former OF-1
- 0.10 g stabiliser ST-1
- 0.70 mg blue sensitiser BS-1
- 0.30 mg stabiliser ST-2

Layer 3 (intermediate layer)
- 1.10 g gelatine
- 0.06 g DOP scavenger EF-1
- 0.06 g DOP scavenger EF-2
- 0.12 g tricresyl phosphate (TCP)

Layer 4 (green-sensitive layer)

green-sensitive silver halide emulsion (99.5 mole % chloride, 0.5 mole % bromide, average grain diameter 0.47 mm), comprising 0.28 g $AgNO_3$, with
- 1.0 g gelatine
- 0.21 g magenta coupler M-17
- 0.15 g stabiliser ST-3
- 0.21 g diisodecyl phthalate (DIDP)
- 0.21 g isotridecanol (ITD)
- 0.70 mg green sensitiser GS-1
- 0.50 mg stabiliser ST-4

Layer 5 (UV protection layer)
- 0.95 g gelatine
- 0.30 g UV absorber UV-1
- 0.06 g DOP scavenger EF-1
- 0.06 g DOP scavenger EF-2
- 0.15 g oil former OF-2
- 0.15 g TCP Layer 6 (red-sensitive layer)

red-sensitive silver halide emulsion (99.5 mole % chloride, 0.5 mole % bromide, average grain diameter 0.5 mm), comprising 0.30 g $AgNO_3$, with
- 1.0 g gelatine
- 0.46 g cyan coupler C-1
- 0.46 g TCP
- 0.03 mg red sensitiser RS-1
- 0.60 mg stabiliser ST-5
- 0.30 g UV absorber UV-2

Layer 7 (UV protection layer)
- 0.30 g gelatine
- 0.10 g UV absorber UTV-3
- 0.10 g oil former OF-3

Layer 8 (protective layer)
- 0.90 g gelatine
- 0.05 g optical brightener WT-1
- 0.07 g mordant (polyvinylpyrrolidone)
- 1.20 mg silicone oil
- 2.50 mg spacer (polymethyl methacrylate, average particle size 0.8 mm)
- 0.30 g hardener H-1

Compounds used in the examples:

Y-1

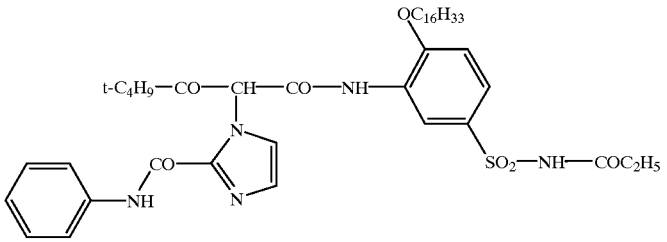

Y-2

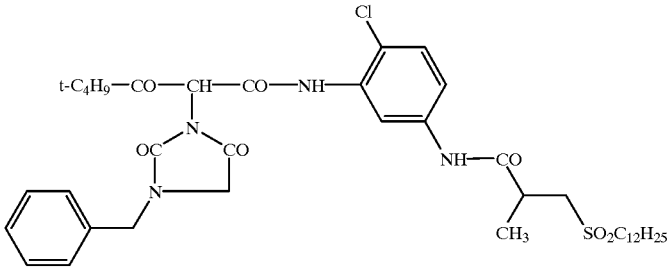

-continued
Y-3
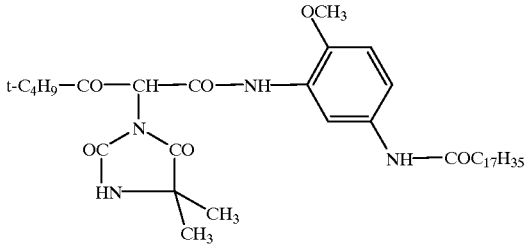
Y-4
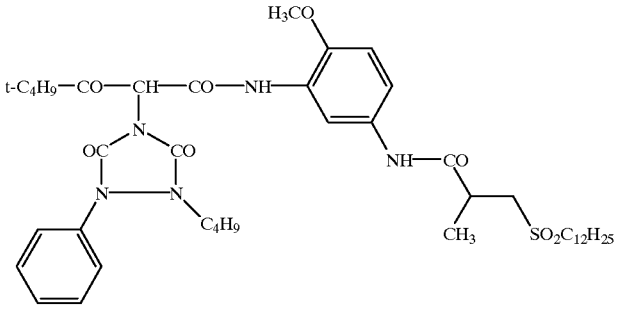
C-1
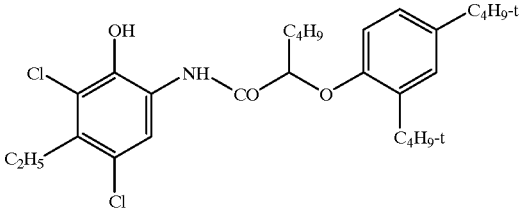
C-2
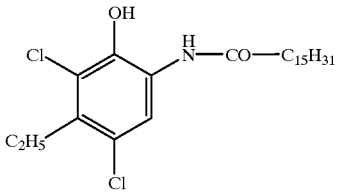
BS-1
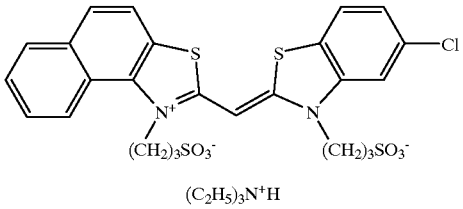
GS-1
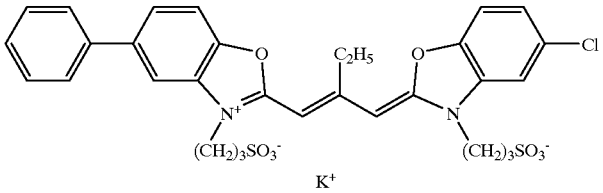
RS-1
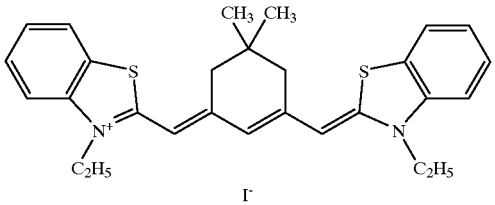
ST-1
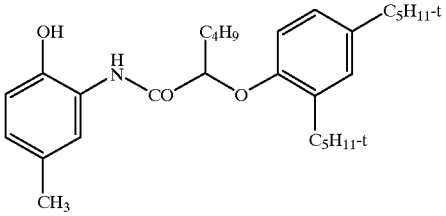

-continued
ST-2
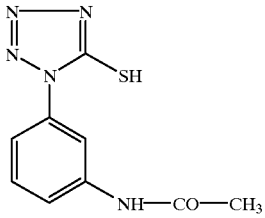
ST-3
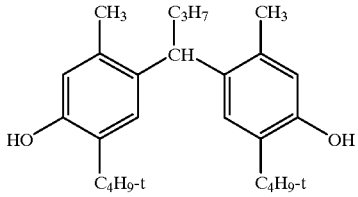
ST-4
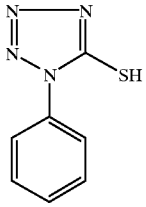
ST-5
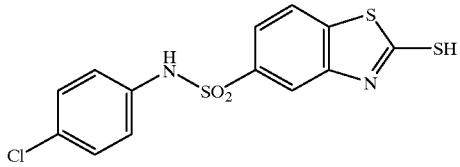
ST-6
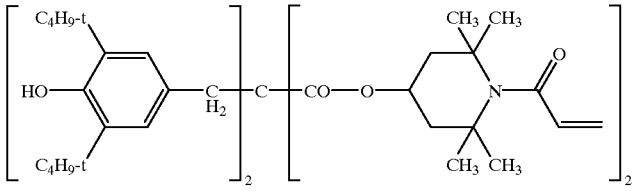
ST-7
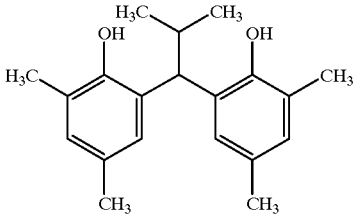
OF-1
a polyester $HO_2C—(CH_2)_4—CO_2H$, $HOCH_2—C(CH_3)_2—CH_2OH$ and $i\text{-}C_{10}H_{21}OH$
$\eta$ (20° C.): 4000–5000 mPa•s
$n_D$ (20° C.): 1.464–1.467
OF-2
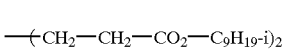
OF-3
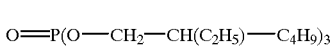
UV-1
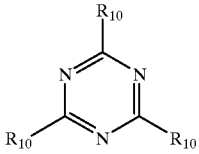
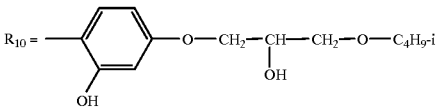
UV-2
a 4:1 mxture of
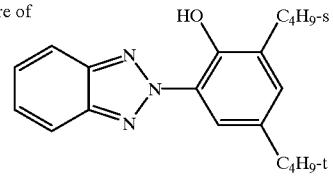
and
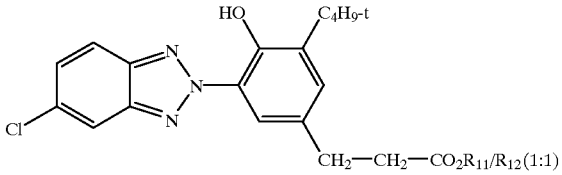
$R_{11}$ = —$C_8H_{17}$-n
$R_{12}$ = —$CH_2$—$CH(C_2H_5)$—$C_4H_9$ -continued

UV-3

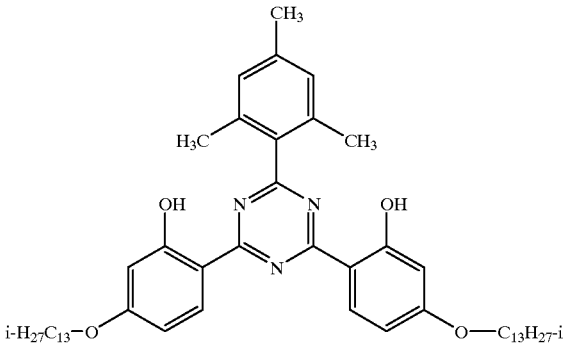

WT-1

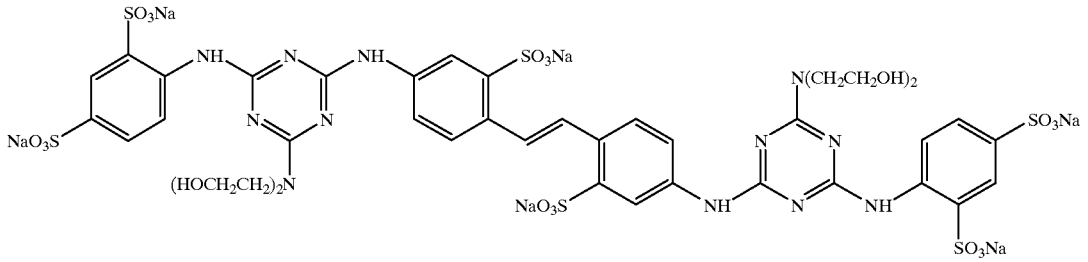

H-1

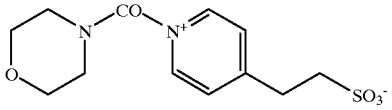

Layer structures 2 to 14

In layer structures 2 to 14, the compounds given in Table 1 were interchanged in layers 2 to 6. When M-9 was used in layer 4, the silver deposit in this layer was also reduced to 0.20 g.

All samples were exposed through a step wedge and a U-531 filter (magenta chromatic component), and were subsequently processed as follows:

a) Colour developer - 45 seconds - 35° C.

| | |
|---|---|
| tetraethylene glycol | 20.0 g |
| N,N-diethylhydroxylamine | 2.0 g |
| N,N-bis-(2-sulphoethyl)-hydroxylamine, disodium salt | 2.0 g |
| N-ethyl-N-(2-methanesulphonamidoethyl)-4-amino-3-methylbenzene sulphate | 5.0 g |
| potassium sulphite | 0.2 g |
| potassium carbonate | 30.0 g |
| polymaleic anhydride | 2.5 g |
| hydroxyethanediphosphonic acid | 0.2 g |
| optical brightener (4,4¢-diaminostilbene-sulphonic acid derivative) | 2.0 g |
| potassium bromide | 0.02 g |

made up to 1000 ml with water; pH adjusted to pH 10.2 with KOH or $H_2SO_4$.

b) Bleach-hardener - 45 seconds - 35° C.

| | |
|---|---|
| ammonium thiosulphate | 75.0 g |
| sodium hydrogen sulphite | 13.5 g |

-continued

| | |
|---|---|
| ethylenediaminetetraacetic acid (iron ammonium salt) | 45.0 g |

made up to 1000 ml with water; pH adjusted to pH 6.0 with ammonia (25% by weight) or acetic acid.

polymaleic anhydride 2.5 g hydroxyethanediphosphonic acid 0.2 g optical brightener (4,40-dianinostilbene-sulphonic acid derivative) 2.0 g potassium bromide 0.02 g made up to 1000 ml with water; pH adjusted to pH 10.2 with KOH or $H_2SO_4$.

b) Bleach-hardener—45 seconds—35° C.

ammonium thiosulphate 75.0 g sodium hydrogen sulphite 13.5 g ethylenediaminetetraacetic acid (iron ammonium salt) 45.0 g made up to 1000 ml with water; pH adjusted to pH 6.0 with ammonia (25% by weight) or acetic acid.

c) Washing—90 seconds—33° C.

d) Drying

The following were used as comparison compounds:

V-1

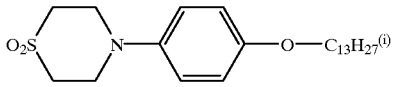

V-2

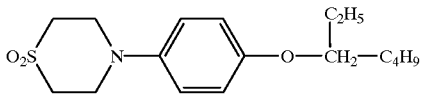

V-3

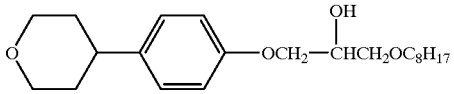

TABLE 1

(C: comparison; I: invention; figures in brackets: deposit in mg/m$^2$)

| | Layer 2 | | Layer 3 | Layer 4 | | | Layer 5 | Layer 6 |
|---|---|---|---|---|---|---|---|---|
| Layer structure | Yellow coupler | Stabiliser | DOP scavenger | Magenta coupler | Stabiliser | Oil former | DOP scavenger | Cyan coupler |
| 1 (C) | Y-1/Y-2 | ST-1 | EF-1/EF-2 | M-17 | V-1 (210)/ST3 | DIDP/ITD | EF-1/EF-2 | C-1 |
| 2 (C) | " | " | " | " | V-3 (210)/ST3 | " | " | " |
| 3 (I) | " | " | " | " | I-2 (210)/ST3 | " | " | " |
| 4 (I) | " | " | " | " | I-24 (210)/II-2 | " | " | " |
| 5 (I) | " | " | VI-2 (100) | " | I-2 (210)/II-2 | " | VI-2 (100) | " |
| 6 (I) | " | " | VII-1 (100) | " | I-19 (210)/ST5 | " | VII-1 (100) | " |
| 7 (C) | Y-3 (520) | ST-6 (150) | EF-1/EF-2 | M-16 (180) | V-2 (210)/ST3 | TCP (400) | EF-1/EF-2 | " |
| 8 (I) | " | " | " | " | I-4 (210)/ST3 | " | " | " |
| 9 (I) | " | " | " | " | I-9 (210)/II-4 | " | " | " |
| 10 (I) | " | " | VII-7 (100) | " | I-20 (210)/III-2 | " | VI-4 (100) | " |
| 11 (C) | Y-4 (500) | ST-7 (125) | EF-1 (60) | M-9 (120) | V-1 (30)/– | TCP/OF-2 (200 /200) | EF-1 (60) | C-1/C-2 (40/240) |
| 12 (I) | " | " | " | " | I-8 (30)/– | " | " | " |
| 13 (I) | " | " | " | " | I-14 (30)/II-5 | " | " | " |
| 14 (I) | " | | VI-4 (50) | " | I-21 (30)/II-5 | " | VII-4 (50) | " |

The samples were subsequently exposed to the light of a 50 klux xenon lamp, normalised to daylight, in a light/dark sequence at $30\times10^6$ lux (fight phase: 3.5 hours, 45° C., 50 % relative humidity / dark phase: 1.5 hours, 30° C., 85% relative humidity). The percentage changes in magenta densities were determined for initial densities D=0.6 and D=1.0 ($DD_{0.6}$, $DD_{1.0}$) (Table 2).

TABLE 2

| Layer structure | $DD_{0.6}$ | $DD_{1.0}$ |
|---|---|---|
| 1(C) | −71 | −55 |
| 2(C) | −82 | −60 |
| 3 (I) | −52 | −40 |
| 4 (I) | −49 | −38 |
| 5 (I) | −39 | −31 |
| 6 (I) | −40 | −32 |
| 7(C) | −77 | −57 |
| 8 (I) | −57 | −42 |
| 9 (I) | −55 | −41 |
| 10 (I) | −42 | −33 |
| 11(C) | −48 | −37 |
| 12 (I) | −38 | −28 |

TABLE 2-continued

| Layer structure | $DD_{0.6}$ | $DD_{1.0}$ |
|---|---|---|
| 13(I) | −37 | −26 |
| 14(I) | −29 | −20 |

As Table 2 shows, the dye stabilisers according to the invention are more effective than the comparison compounds V-1, V-2 and V-3. The stability in relation to light is improved again by the use of compounds of formulae VI or VII as DOP scavengers, instead of EF-1 and/or EF-2.

What is claimed is:

1. A color photographic material which comprises a support and containing at least one light-sensitive silver halide emulsion layer and at least one color coupler associated with this layer, and the silver halide emulsion layer contains at least one compound of formula (I)

(I)

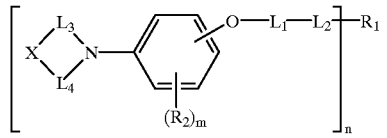

wherein m is 0, 1, 2, 3 or4, n is2, 3, 4, 5 or6, $R_1$ is a di- to hexavalent group, $R_2$ is alkyl, alkenyl, cycloalkyl, aryl, alkoxy, aryloxy, alkylthio, arylthio, acyl, alkoxycarbonyl, aryloxycarbonyl, hydroxy, halogen, cyano, —$SO_2R_5$, —$SOR_5$, —$CON(R_5)R_6$ or —$SO_2N(R_5)R_6$, $L_1$ is alkylene, arylene, aralkylene or alkylidene, $L_2$ is

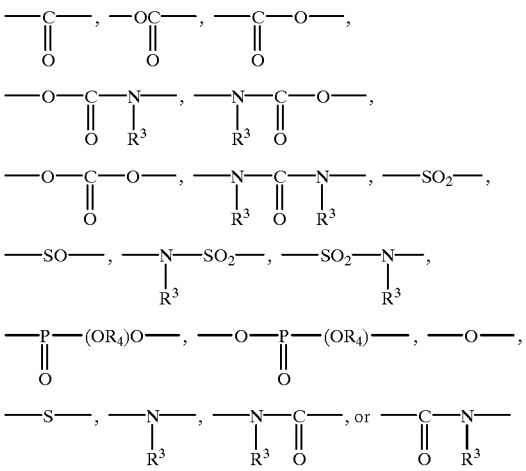

$L_3$ and $L_4$ are identical or different and are a $C_1$–$C_3$ alkylene which is optionally substituted, X is

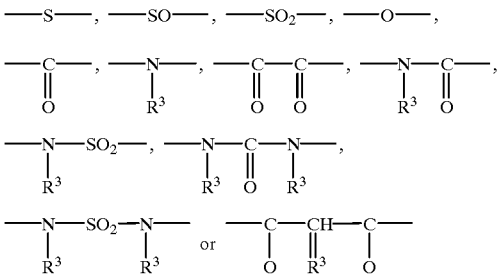

$R_3$ is H, acyl, $—SO_2R_5$, alkoxycarbonyl, aryloxycarbonyl, alkyl, aryl, alkenyl or the radical of a heterocycle, $R_4$ is H, alkyl, aryl or the radical of a heterocycle, $R_5$ is alkyl or aryl, and $R_6$ is H, alkyl or aryl, wherein 2 radicals $R_3$ and $R_4$ may be the same or different and at least one light-sensitive layer contains a compound of formula VI or VII (VI)

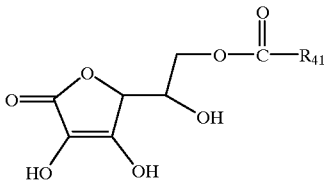

wherein $R_{41}$ is alkyl, alkoxy, alkyamino, aryl, aryloxy or arylamino, and $R_{41}$ contains at least 12 C atoms.

VII

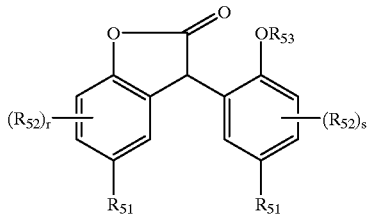

wherein $R_{51}$ and $R_{52}$ are identical or different and are alkyl, alkoxy, acylamino, acyloxy, alkoxycarbonylamino, $N^1$-alkyl-ureido, $N^1$-arylureido or sulphonylamino, and $R_{53}$ is H, alkyl, acyl, alkyl carbamoyl, alkoxy carbonyl or alkyl sulfonyl, r and s are identical or different and are 0, 1 or 2, and wherein a plurality of radicals $R_{51}$ and $R_{52}$ may be the same or different and adjacent radicals $R_{51}$ and $R_{52}$ can form a 5- to 6-membered ring.

2. The color photographic material according to claim 1, wherein $R_1$ is a di- to hexavalent aliphatic or aromatic group, $R_2$ is alkyl, alkoxy, acyl, alkoxycarbonyl or hydroxy, $R_3$ is H or alkyl, $L_1$ is alkylene, arylene or aralkylene, $L_2$ is

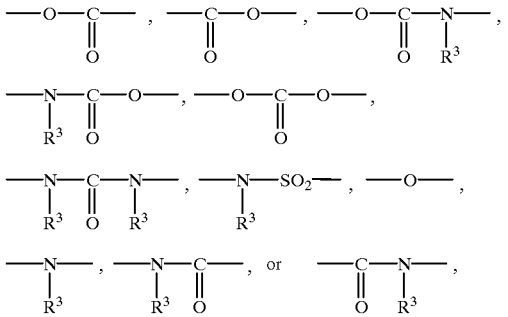

X is —SO—, $—SO_2—$, —CO— or —O—, and m is 0, 1 or 2, wherein $L_3$ and $L_4$ together contain 3 to 5 C atoms.

3. The color photographic material according to claim 1, wherein the compounds of formula I have a molecular weight of at least 650.

4. The color photographic material according to claim 1, wherein the compounds of formula I are used in an amount of 5 to 1500 mg/$m^2$ of the photographic material.

5. The color photographic material according to claim 1, wherein color coupler is magenta coupler.

6. The color photographic material according to claim 5, wherein the magenta coupler is a pyrazolotriazole magenta coupler.

7. The color photographic material according to claim 1, wherein the coupler-containing silver halide emulsion layer additionally contains at least one compound of formulae II or III:

(II)

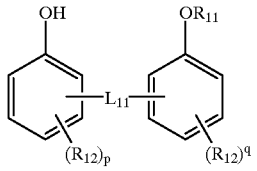

wherein $R_{11}$ is H, acyl, alkoxycarbonyl, —CON($R_5$)$R_6$, —$SO_2R_5$, —$SO_2N(R_5)R_6$, aryloxycarbonyl, alkyl or alkenyl, $R_{12}$ is alkyl, aryl, aralkyl, alkenyl, halogen, alkoxy, acyloxy, aryloxy, acyl, acylamino, —CON($R_6$)$R_6$, alkoxycarbonylamino, —N($R_6$)CON($R_5$)$R_6$, alkoxycarbonyl or aryloxycabonyl, p and q are identical or different and are 0 or a number from 1 to 4, $L_{11}$ is —S—, —SO—, —$SO_2$—, —C(=O)— or

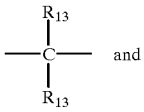

and $R_{13}$ is H, alkyl, aryl, acyl, alkoxycarbonyl, —CON($R_5$)$R_6$ or aryloxycarbonyl, wherein a plurality of radicals $R_{12}$ and $R_{13}$ may be the same or different, and one substituent is situated para to the OH or $OR_{11}$ in each case;

(III)

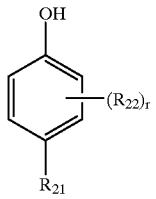

wherein $R_{21}$ is alkyl, aryl, alkoxy, aryloxy, hydroxy, acyl, alkoxycarbonyl, aryloxycarbonyl, —CON($R_5$)$R_6$, —$SO_2R_5$, —$SO_2N(R_5)R_6$, alkoxycarbonylamino, —N($R_6$)CON($R_5$)$R_6$ or acyloxy.

$R_{22}$ is $R_{21}$ or halogen, and r is O or an integer from 1 to 4, wherein a plurality of radicals R may be the same or different.

8. The color photographic material according to claim 7, wherein the compounds of formulae II and III are used in a total amount of 50 to 1500 mg/$m^2$ of the color photographic material.

9. The color photographic material according to claim 6, wherein said pyrazolotriazole magenta coupler is of the formulae (IV) or (V)

(IV)

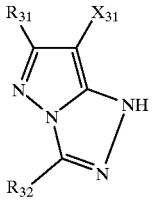

(V)

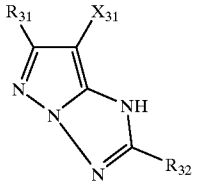

wherein $X_{31}$ is H or a group which is split off under the conditions of chromogenic development, $R_{31}$ is an alkyl, which is optionally substituted, and $R_{32}$ is $R_{31}$, or aryl, wherein the sum of all the C atoms of Radicals $R_{31}$ and $R_{32}$ in a coupler molecule is at least 12.

10. The color photographic material according to claim 9, wherein the compounds of formulae VI and VII are used in a total amount of 5 to 1000 mg/$m^2$.

11. The color photographic material according to claim 1, wherein the compounds of formulae VI and VII are used in a total amount of 10 to 500 mg/$m^2$.

12. The color photographic material according to claim 7, wherein the compounds of formulae II and III are used in a total amount of 5 to 1500 mg/$m^2$ of the color photographic material.

13. The color photographic material according to claim 7, wherein the compounds of formulae II and III are used in a total amount of 10 to 750 mg/$m^2$ of the color photographic material.

14. The color photographic material according to claim 11, wherein the compounds of formula I are used in an amount of 10 to 500 mg/$m^2$ of the photographic material.

* * * * *

UNITED STATES PATENT AND TRADEMARK OFFICE

CERTIFICATE OF CORRECTION

PATENT NO. : 6,221,572 B1
DATED : April 24, 2001
INVENTOR(S) : Jörg Hagemann et al.

It is certified that error appears in the above-identified patent and that said Letters Patent is hereby corrected as shown below:

Column 35,
Last line, "R" should appear as -- $R_{22}$ --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,221,572 B1
DATED : April 24, 2001
INVENTOR(S) : Jörg Hagemann et al.

It is certified that error appears in the above-identified patent and that said Letters Patent is hereby corrected as shown below:

Title page,
Item [73], Assignee, should read -- AGFA– GEVAERT (BE) --.

Signed and Sealed this

Eighth Day of January, 2002

*Attest:*

*Attesting Officer*

JAMES E. ROGAN
*Director of the United States Patent and Trademark Office*